US006202352B1

(12) United States Patent
Wilkes

(10) Patent No.: US 6,202,352 B1
(45) Date of Patent: Mar. 20, 2001

(54) DECORATIVE DOOR GUARD SYSTEM

(76) Inventor: John M. Wilkes, 208 Lucille St., Glenshaw, PA (US) 15116

( * ) Notice: Subject to any disclaimer, the term of this patent is extended or adjusted under 35 U.S.C. 154(b) by 0 days.

(21) Appl. No.: 09/526,001

(22) Filed: Mar. 15, 2000

(51) Int. Cl.[7] ..... E05B 1/00

(52) U.S. Cl. ..... 49/460

(58) Field of Search ..... 49/460; D8/300, D8/301, 305

(56) References Cited

U.S. PATENT DOCUMENTS

D. 326,996 * 6/1992 Birch ..... D8/350
5,575,117 * 11/1996 Soltis et al. ..... 49/460

* cited by examiner

*Primary Examiner*—Jerry Redman
(74) *Attorney, Agent, or Firm*—John D. Gugliotta

(57) ABSTRACT

A door guard apparatus is provided having a first layer of adhesive, a middle layer providing structural rigidity and resistance to structural penetration, and a decorative outer overlay affixed to the middle layer. A knob access penetrates all the layer to allow for mounting about a doorknob.

5 Claims, 5 Drawing Sheets

DECORATIVE DOOR GUARD SYSTEM

BACKGROUND OF THE INVENTION

1. Field of the Invention

The present invention relates generally to escutcheons and door guards and, more particularly, to a decorative door guard system.

2. Description of the Related Art

There currently exists a wide variety of products, generally available, to protect paint and home finishes such as plastic corner protectors for outside wall corners, clear plastic switch plates that protect the finish around electrical wall switches, and other similar devices. One area that also sees frequent contact with a user's hand but is not afforded any protection is that area of a door around a door handles.

In the related art, the following design patents disclose a door guard or escutcheon for a door lock: U.S. Pat. No. D 411,732 issued in the name Chamberlain; U.S. Pat. No. D 326,996 issued in the name Birch; U.S. Pat. No. D 326,806 issued in the name of Marques; U.S. Pat. No. D 247,845 issued in the name of Palm, Jr.; U.S. Pat. No. D 246,503 issued in the name of Clayton; and U.S. Pat. No. D 359,673 issued in the name of McNeal.

The following design patents disclose an escutcheon or wall plate: U.S.

Patent no. D 245,223 issued in the name of Fine; U.S. Pat. No. D 261,228 issued in the name of Shames et al.; U.S. Pat. No. D 229,478 issued in the name of Tegner.; and U.S. Pat. No. D 380,854 issued in the name of Bray discloses a lighting assembly cover.

U.S. Pat. No. D 396,181 issued in the name of Chang discloses a cover for electrical outlets.

Consequently, there exists a need for a means by which the finish or paint of a door around a door handle can be protected from damage, dirt, grease and grime.

SUMMARY OF THE INVENTION therefore, it is an object of the invention to indicate a device of the type disclosed above which avoids the disadvantages inherent in the state of the art. In particular, the device is to protect door from dirt, grease and grime around door knobs, and also protects door from scratches and/or dents. It should be capable of use on any interior door, capable of fitting over existing door knob without disassembly of door required. Removability should allow the invention to be moved from one door to another, and multiple styles or theme designs can matches any decor or can be cut in outline of favorite things; sports, pets, seasons, toys and the like. Further, many styles are anticipated as being symmetrical about a vertical centerline, thereby allowing the guard not only to be moved from one door to another, but also between the inside of the door and outside of the door, or affixed at both sides of the door.

Briefly described according to one embodiment of the present invention, apparatus is provided that protects the paint and finish of a door around a door knob from dirt, grease and smudges. In its most basic form, it would be rectangular in shape with a hole for the doorknob in the middle. The invention would be placed over the doorknob, centered around the door knob and fastened into place using a series of fasteners such as screws. In this manner, any dirt, grease or other foreign materials on a persons hand would not be able to be transferred to the door and possible damage the paint or finish. It would also be capable of covering existing doors which already have been damaged. It is envisioned that he invention would be available in multiple styles and colors to fit any decor. The overall shape of the invention could be cut to produce an outline profile of a specific theme such as a cat for cat lovers or a football for sports lovers. It would be especially advantageous on bedroom doors, basement doors or outside doors that tend to get dirtier than other doors. The use of the present invention allows for the protection of door finishes around door knobs in a manner that is quick, easy and effective while producing a visual result that is complimentary to any decor.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
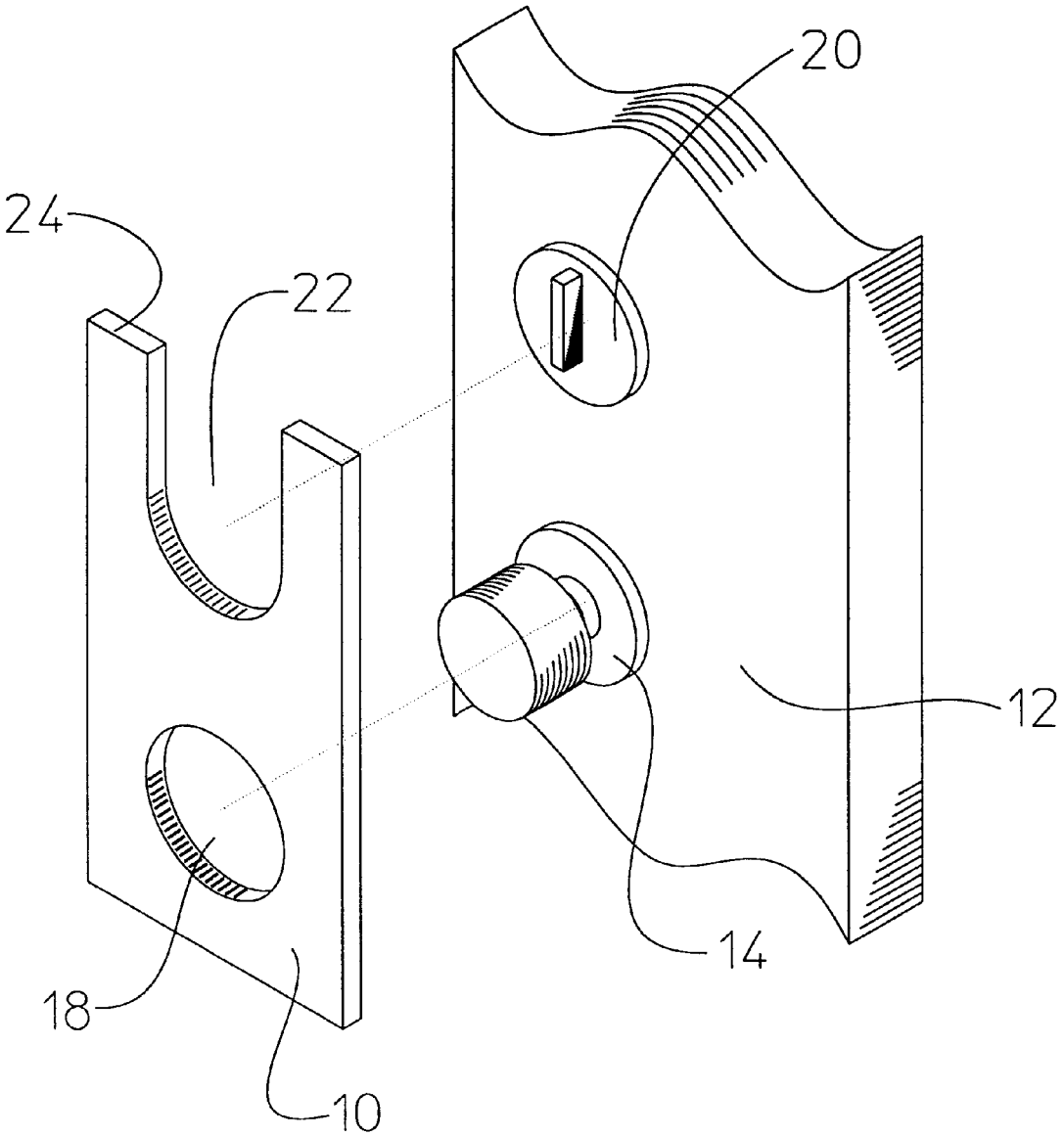
FIG. 1 is a perspective view of a door guard according to the general embodiment of the door guard system of the present invention, shown being applied to a door 12.
Figure 2:
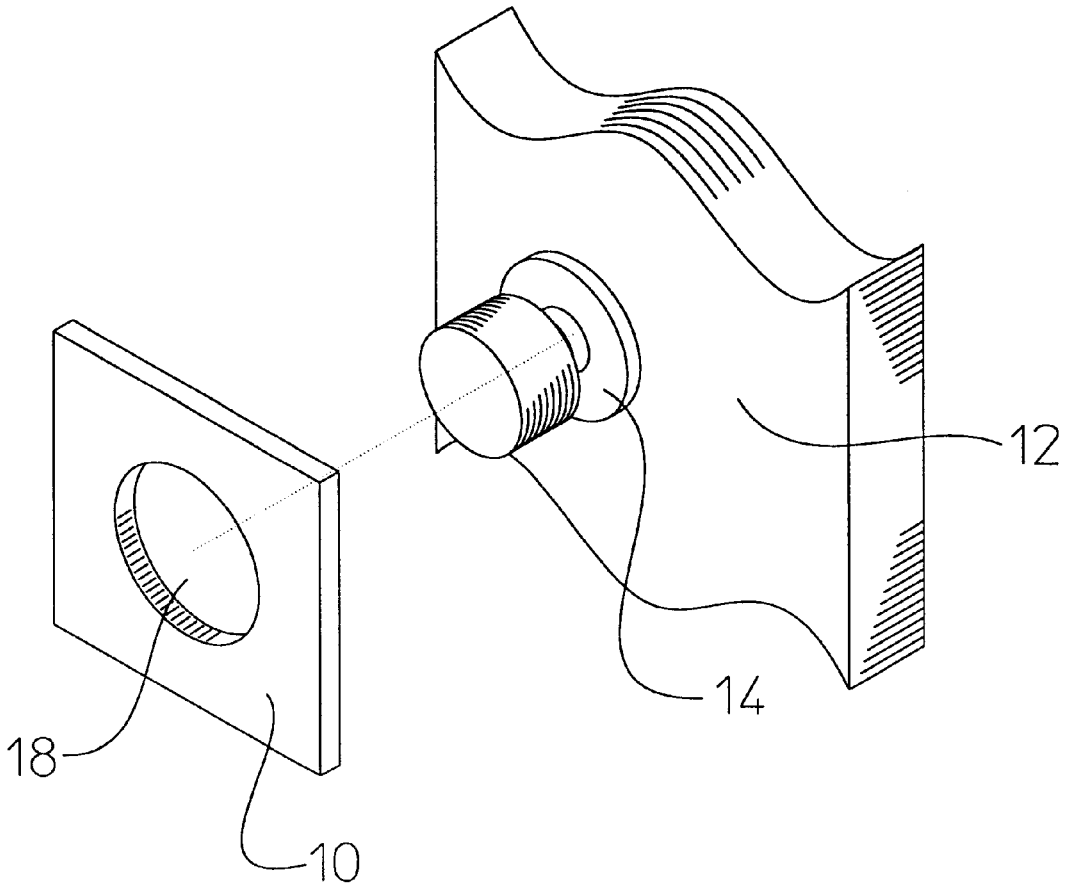
FIG. 2 is a perspective view of a door guard system according to a first alternate embodiment, shown being applied to a door 12 having a deadbolt lock 20.
Figure 3:
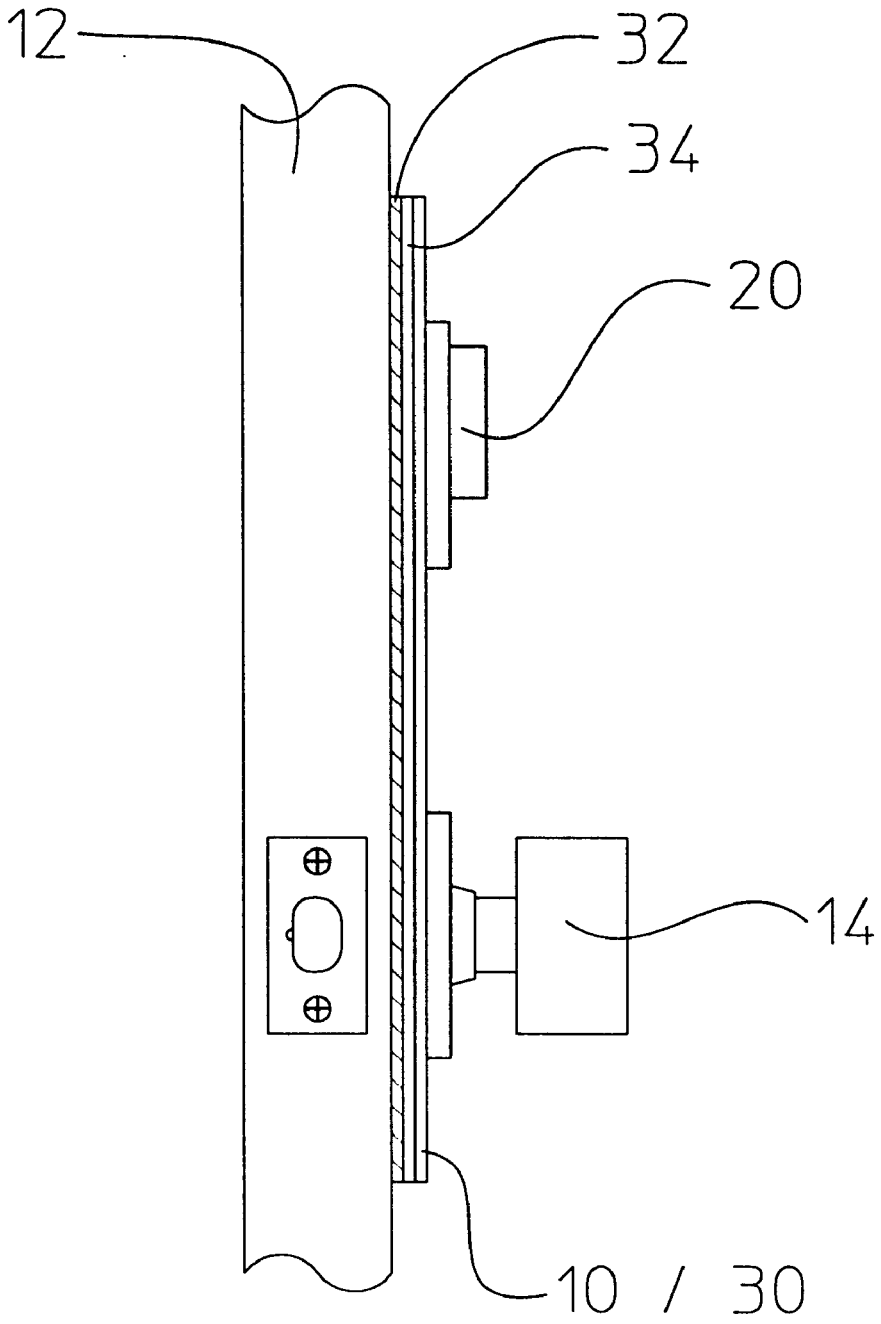
FIG. 3 is a side elevational view of a door guard system for any embodiment of the present invention.
Figure 4A:
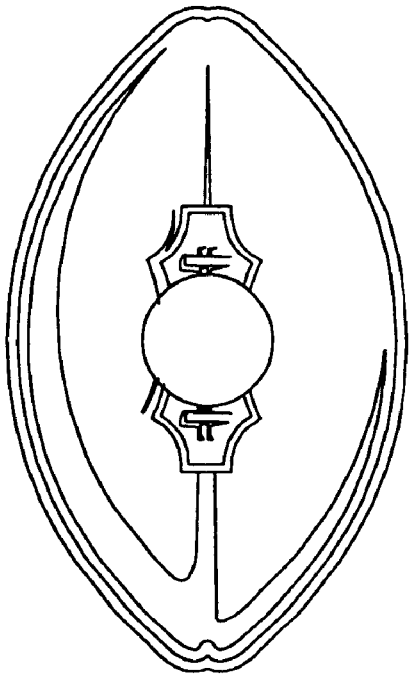
FIG. 4*a*–4*d* are front elevational views of various decorative outer plates 30 for use with the door guard system of the present invention.
Figure 4B:
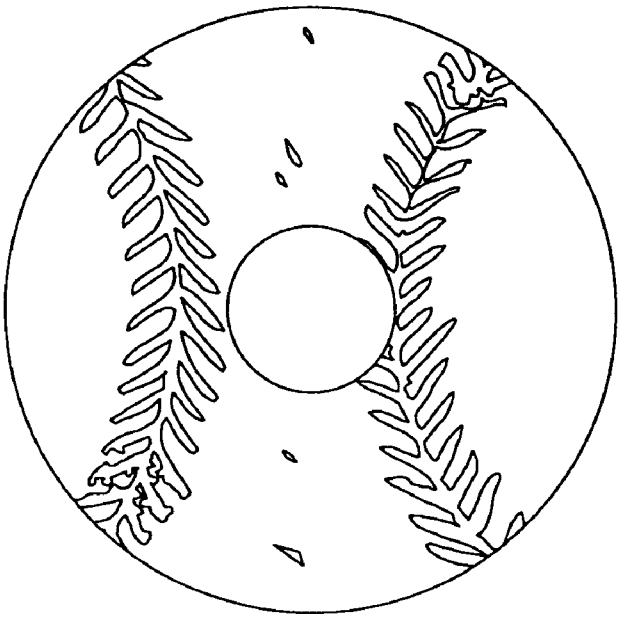
Figure 4C:
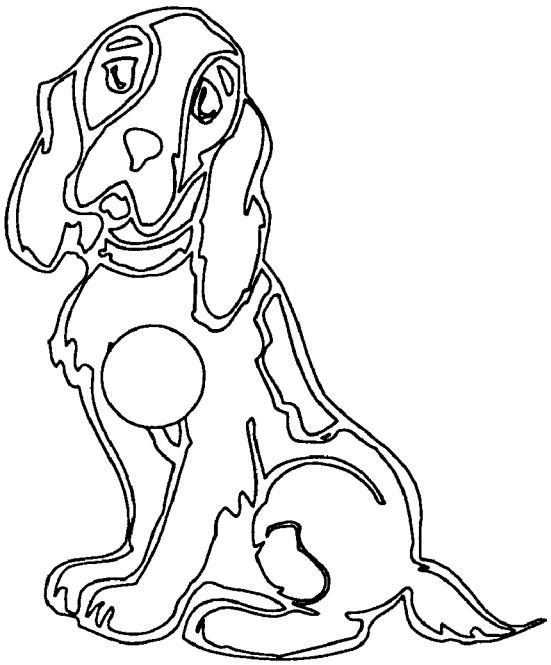
Figure 4D:
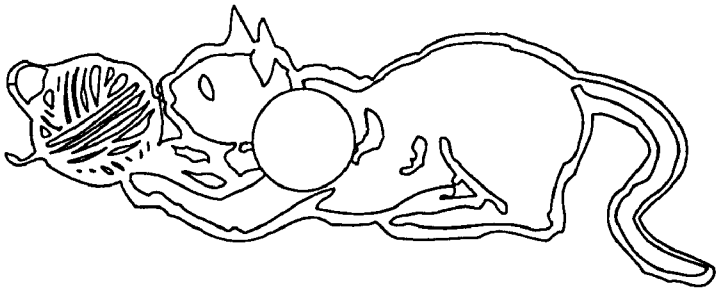

Referring now to FIGS. 1–3, a door guard apparatus 10 is shown, according to the present invention, for application to a door 12 for shielding and protection of the surface area about a door knob 14. The door guard 10 forms a knob access orifice 18 near the middle and within the outer perimeter of the decorative outer plate 30. Considered as an embodiment congruent with the present teachings, for doors 12 having a deadbolt lock 20 it is envisioned that the door guard 10 will additionally form a deadbolt access indentation 22 formed along the upper edge 24 of the decorative outer plate 30.

As best shown in conjunction with FIG. 3, shown is the preferred embodiment of the present invention in which the door guard 10 is formed of a plurality of layers of material, specifically, a first layer 32, forming an attachment means for affixing to the surface of the door 12, and anticipated as being an adhesive layer for firm but removable attachment to the door 12. The adhesive is bound to a middle layer 34, forming a support substrate to provide structural rigidity and resistance to structural penetration of the door guard 10. Finally, affixed to the outer surface of the support substrate 34 is a decorative outer overlay, shown as decorative outer plate 30.

Alternate embodiments are also envisioned for practicing the attachment means 12. By way of example, and not as a limitation, one such alternate embodiment is envisioned as a pair of key shaped slots, placed vertically aligned, that allow a conventional screw fastener to penetrate the door guard 10 and physically impinge against the outer plate 30. Further, by orienting the key shaped slots alternate to one another, the user can easily install, remove, or change the door guard 10 in a manner similarly as easy as with an adhesive based attachment means. Further, by standardizing the size and locations of these key-shaped slots between decorative outer plates, interchangeability can be easily attained. fasten It is envisioned that the outer plate 30 would be available in multiple styles and colors to fit any decor. For purposes of disclosure, and now by way of limitation, shown in FIG. 4*a*–4*d* the overall shape of the outer plate 30 could be cut to produce an outline profile of a specific theme such as a cat or dogs for pet lovers or a football or baseball for sports fans. It would be especially advantageous on bedroom doors, basement doors or outside doors that tend to get dirtier than other doors. The use of the present invention allows for the protection of door finishes around door knobs in a manner that is quick, easy and effective while producing a visual result that is complimentary to any decor. Further, replacement of new or different decorative outer plates 30 can be interchanged upon existing support substrates 34 to allow the user to maintain aesthetics.

2. Operation of the Preferred Embodiment

In accordance with a preferred embodiment of the present invention, as shown in the figures, the invention would be placed over the doorknob, centered around the door knob and fastened into place. In this manner, any dirt, grease or other foreign materials on a persons hand would not be able to be transferred to the door and possible damage the paint or finish. It would also be capable of covering existing doors which already have been damaged.

As designed, a device embodying the teachings of the present invention is easily applied. The foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A door guard apparatus comprising:

a first layer, said first layer forming an attachment means for affixing to the surface of a door;

a middle layer forming a support substrate to provide structural rigidity and resistance to structural penetration;

a decorative outer overlay affixed to an outer surface of the support substrate;

knob access orifice within the outer perimeter of said decorative outer plate, said knob access orifice penetrating all said layers; and a deadbolt access indentation formed along the upper edge of the decorative outer plate.

2. The door guard apparatus of claim 1, wherein said decorative outer overlay is formed in an outline profile of a specific theme element.

3. The door guard apparatus of claim 2, wherein said specific theme element is selected from a group comprising pets.

4. The door guard apparatus of claim 2, wherein said specific theme element is selected from a group comprising sports memorabilia.

5. The door guard apparatus of claim 1, wherein said attachment means comprises an adhesive layer.

* * * * *